US006447247B1

(12) United States Patent
Geiger

(10) Patent No.: US 6,447,247 B1
(45) Date of Patent: Sep. 10, 2002

(54) STEAM TURBINE

(75) Inventor: Matthias Geiger, Wachtendonk (DE)

(73) Assignee: Siemens Aktiengesellschaft, Munich (DE)

( * ) Notice: Subject to any disclaimer, the term of this patent is extended or adjusted under 35 U.S.C. 154(b) by 20 days.

(21) Appl. No.: 09/684,242

(22) Filed: Oct. 6, 2000

Related U.S. Application Data

(63) Continuation of application No. PCT/DE99/01043, filed on Apr. 6, 1999.

(30) Foreign Application Priority Data

Apr. 6, 1998 (DE) ..... 198 15 375

(51) Int. Cl.[7] ..... F01D 1/02

(52) U.S. Cl. ..... 415/211.1; 415/211.2; 415/226

(58) Field of Search ..... 415/208.2, 211.2, 415/221, 226, 101, 103, 207, 220; 60/690, 692, 694

(56) References Cited

U.S. PATENT DOCUMENTS 5,518,366 A * 5/1996 Gray ..... 415/211.2

* cited by examiner

*Primary Examiner*—F. Daniel Lopez
*Assistant Examiner*—Kimya N McCoy
(74) *Attorney, Agent, or Firm*—Laurence A. Greeneberg; Werner H. Stemer; Gregory L. Mayback

(57) ABSTRACT

A steam turbine has an axis of rotation, an inlet in an exhaust steam region for steam, and a flow duct for conducting the steam and extending in a direction of the axis of rotation. The flow duct widens, toward the exhaust steam region, to an outlet opening. The outlet opening is associated with a flow guidance element that extends beyond the outlet diameter of the outlet opening.

13 Claims, 3 Drawing Sheets

STEAM TURBINE

CROSS REFERENCE TO RELATED APPLICATION

This is a continuation of copending International Application PCT/DE99/01043, filed Apr. 6, 1999, which designated the United States.

BACKGROUND OF THE INVENTION

1. Field of the Invention

The invention relates to a steam turbine with a flow duct, for steam, which extends along an axis of rotation from an inlet region to an evaporation region. The flow duct widens toward an evaporation region to an outlet opening with an outlet diameter.

A steam turbine is generally employed in a power station installation to drive a generator and for the generation of hot steam or in an industrial installation to drive a machine. For this purpose, steam used as a flow medium is supplied to the steam turbine and expands with an output of power. After complete expansion of the steam, the latter can flow via an exhaust steam casing of the steam turbine into a downstream condenser and can condense there. The flow through an appropriate exhaust steam casing can then be axial or radial.

In a power station installation for the generation of electrical power, a steam turbine installation is generally provided which has a high-pressure steam turbine, a medium-pressure steam turbine and a low-pressure steam turbine, which are connected in flow sequence. The steam expanded in the low-pressure steam turbine is supplied to a condenser and is condensed in the latter. The efficiency of such a steam turbine installation is determined by a number of parameters and, in particular, the efficiency is limited by flow resistances occurring in the steam turbine installation.

Published, European Patent Application EP 0 345 700 A1 reveals an outlet casing of a turbomachine, in particular a steam turbine, for reducing energy losses due to vortices and separations of the steam flow. The outlet casing has a circular diffuser with two separate outlet flow ducts connected to its widened end. A rear outlet flow duct, which is bounded by the rear wall of the casing, extends in a straight line and transverse to the longitudinal axis of the machine. The front outlet flow duct is guided by a bend section extending in the diffuser against the flow direction and it extends downward parallel with the rear outlet flow duct. The two flow ducts are separated from one another by a partition. In the rear outlet flow duct, an oblique rear wall extending over the complete width of the duct is disposed at the lower edge of the diffuser, which wall reaches from the diffuser to the partition. In the outlet casing disclosed in the European Patent Application EP 0 345 700 A1, the steam emerging from the steam turbine is divided into two partial steam flows which are separated from one another by a partition and are guided independently of one another into a condenser.

An appliance for removing the working fluid from axial turbines is disclosed in Published, Swiss Patent Application CH-326 301 A. In this configuration, a major part of the velocity energy of the working fluid is converted into pressure energy by an annular diffuser being fitted upstream of the working fluid removal space (exhaust steam struts) in the appliance by which the working fluid emerging from the last rotor blade row is deflected from the axial flow direction into a direction which is, on the average, radial; the working fluid deflected into the radial direction flows through the diffuser. The pressure in the last turbine stage can, therefore, be reduced to below the outlet flow pressure and, in this way, pressure losses in the outlet flow region are reduced.

SUMMARY OF THE INVENTION

It is accordingly an object of the invention to provide a steam turbine which overcomes the above-mentioned disadvantages of the prior art devices of this general type, in which small flow losses occur.

With the foregoing and other objects in view there is provided, in accordance with the invention, a steam turbine having an axis of rotation; an inlet for receiving steam and is disposed above the axis of rotation; an exhaust steam region for conducting the steam; an outlet flow region; and a flow duct for conducting the steam and extending in a direction of the axis of rotation. The flow duct has an outlet opening with an outlet diameter. The flow duct widens toward the exhaust steam region to the outlet opening. A flow guidance element is associated with the outlet opening for conducting the steam flowing out of the outlet opening. The flow guidance element extends beyond the outlet diameter of the outlet opening and extends along an outlet flow direction into the outlet flow region. The flow guidance element widens along the outlet flow direction or has a substantially constant width, so that the steam can be guided on both sides of the flow guidance element and a thorough mixing of the steam takes place downstream of the flow guidance element.

The steam turbine has a flow duct that extends along an axis of rotation and widens (from a steam inlet region to an exhaust steam region) toward the exhaust steam region and ends with an outlet opening having an outlet diameter. The object is achieved, in accordance with the invention, by the flow guidance element, associated with the outlet opening, for conducting steam emerging from the outlet opening. The flow guidance element extends beyond the outlet diameter and, also along an outlet flow direction into an outlet flow region. The flow guidance element widens along the outlet flow direction or has an essentially constant width, so that steam can be guided on both sides of the flow guidance element and a thorough mixing of the steam takes place downstream of the flow guidance element.

The invention is based on the knowledge that at the outlet opening of the widened flow duct (axial/radial diffuser), an area-dependent static pressure is present which is larger than an area-dependent static pressure further downstream, in particular at an inlet flow plane of a condenser (condenser throat). Because of this, there is a high pressure loss, which occurs in particular due to strong eddying of the flow, which is produced by vortices. Such vortices can occur because steam from the outlet opening is, on the one hand, deflected radially downward and, on the other hand, radially upward, the steam deflected radially upward being further deflected downward and flowing along with the steam which has already been deflected downward originally. The steam initially deflected upward can be divided into two steam flows which flow downward and, in the process, swirl and respectively form a trailing vortex. The origin of these trailing vortices lies above the outer inner casing, which surrounds the flow duct.

The flow guidance element, around which emerging steam flows on both sides, preferably only extends partially in the direction of the outlet flow direction into the outlet flow region so that a mixing region is left downstream of the flow guidance element as far as the inlet flow plane of the condenser, so that an adequately thorough mixing and adequate uniformity of the total steam flow is achieved. There is, therefore, a uniform incident flow at the inlet flow plane of the condenser, which ensures low loading on the condenser.

A more uniform mass flow density distribution and a reduction in the vortex strength is made possible by the flow guidance element associated with the outlet opening, particularly in the region where the steam flowing out directly downward mixes with the steam which has been deflected from above. This configuration causes a reduction in the pressure losses during the outflow of steam from the outlet opening into the exhaust steam region and therefore contributes to an increase in the efficiency of the steam turbine. In the outlet flow region, which is formed for example between the outlet opening and the inlet flow plane of a condenser, therefore, thorough mixing of the steam flow is only achieved downstream of the flow guidance element. This thorough mixing extending to the inlet flow plane of the condenser also produces a more uniform steam flow, which leads to a uniform incident flow and uniform loading on the condenser, in particular on the condenser plates. This reduces the droplet impact loading in the condenser and increased loading due to partial steam flows which have not been thoroughly mixed and have different flow velocities (steam jets). In the outlet flow region, therefore, a thorough mixing of the steam flowing out from above and the steam flowing out from below is at least markedly reduced directly following the outlet opening and, at the same time, the total emerging steam flow is made more uniform downstream of the flow guidance element, so that a reduction in friction losses, such as occur, for example, in the case of separate outlet flow ducts, is achieved in the outlet flow region downstream of the flow guidance element.

The flow guidance element preferably extends along the outlet flow direction with a constant width or widens along the outlet flow direction, in particular with an increasing distance from the axis of rotation. Due to a constant width or a widening of the flow guidance element with an increasing distance from the axis of rotation, the thorough mixing between the steam originally guided upward and the steam deflected directly downward is reduced in the region where the flow guidance element extends so that, by this, the pressure loss is also reduced. The flow guidance element is preferably disposed geodetically below the axis of rotation, so that an effective guidance of the flow of the steam emerging downward is achieved. In this configuration, the steam turbine can preferably be divided on a horizontal plane, which includes the axis of rotation, and it has a joint in this plane. The flow guidance element is preferably inclined, relative to the axis of rotation, at a guide angle in the range between 70° and 110°, in particular between 85° and 95°. The flow guidance element is preferably inclined at an angle of approximately 90°, i.e. it is perpendicular to the axis of rotation. Therefore, the influence of the trailing vortex on the outlet flow of the steam emerging downward from the widening flow duct (diffuser) is reduced below the joint. The formation of a shear flow between the steam flowing out directly downward and the steam initially flowing out upward is therefore also located further downstream, with a corresponding reduction in flow losses.

The flow guidance element is preferably immediately adjacent to the outlet opening, so that the steam emerging from the outlet opening is guided by the flow guidance element after emergence from the outlet opening. Mixing and eddying of the steam because of a distance between the outlet opening and the flow guidance element is reliably prevented.

The flow guidance element is preferably essentially planar, and therefore a flow duct with planar walls is formed by the flow guidance element and, for example, an outer casing of the steam turbine. It is likewise possible to embody the flow guidance element with a curved surface corresponding to the desired guidance of the steam for the further reduction in flow losses. The specific form of the flow guidance element can be determined by experiments and by three-dimensional flow calculations.

The flow guidance element is preferably manufactured from a plate. This is a particularly simple structural configuration of the flow guidance element and this configuration also, for example, permits a steam turbine to be retrofitted with a flow guidance element during maintenance work.

The flow guidance element is preferably adjacent to an outer casing, which surrounds an inner casing surrounding the flow duct. In this configuration, it preferably extends completely over the width of the cross section formed by the outer casing. This effectively avoids thorough mixing of steam descending from above with the steam emerging downward over the cross section occurring between the outer casing and the inner casing. Thorough mixing of the steam flow guided downward from above, in the trailing vortices, with the steam flow emerging directly downward is therefore displaced to a region further downstream, by which a reduction in pressure losses is achieved.

The flow guidance element is preferably fastened to the outer casing. In addition to a flow guidance element fastening which is stable in the long term, this achieves a stiffening of the outer casing of the steam turbine in the exhaust steam region.

The steam turbine is preferably embodied as a low-pressure steam turbine that is, in particular, embodied as a double-flow turbine. The flow guidance element is preferably used for flow guidance to a condenser.

Other features which are considered as characteristic for the invention are set forth in the appended claims.

Although the invention is illustrated and described herein as embodied in a steam turbine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
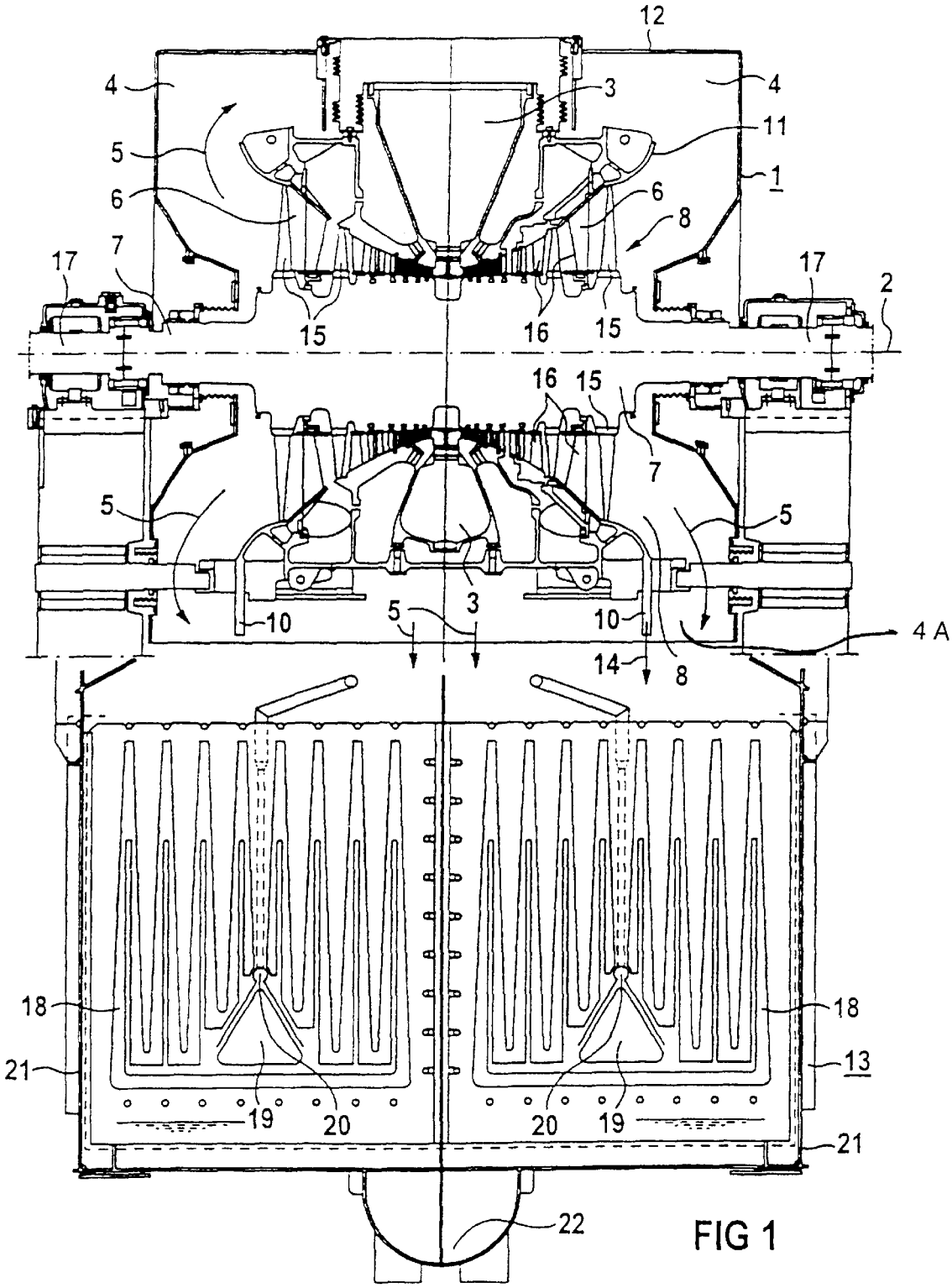
FIG. 1 is a diagrammatic, longitudinal sectional view through a low-pressure steam turbine with a condenser according to the invention.

In all the figures of the drawing, sub-features and integral parts that correspond to one another bear the same reference symbol in each case. Referring now to the figures of the drawing in detail and first, particularly, to FIG. 1 thereof, there is shown a longitudinal sectional view through a low-pressure steam turbine 1, which is embodied as a double-flow turbine. It has a turbine shaft 7 extending along an axis of rotation 2. An inlet region 3 for steam 5 is provided in a central region of the low-pressure steam turbine 1, the steam 5 flowing to the inlet region 3 via, in particular, a non-illustrated transfer conduit from a non-illustrated medium-pressure steam turbine. A flow duct 6, which is formed between the turbine shaft 7 and an inner casing 11 surrounding the turbine shaft 7, extends in each case along an axis of rotation 2 on both sides of and symmetrical relative to the inlet region 3. A plurality of guide vanes 16 and rotor blades 15 are alternately disposed in sequence in each flow duct 6. The flow duct 6 widens from the inlet region 3 along the axis of rotation 2 toward an exhaust steam region 4. The flow duct 6 has an outlet opening 8 associated with the exhaust steam region 4. Geodetically disposed below the outlet opening 8, there is a flow guidance element 10 which extends downward along an outlet flow direction 14 in a plane, which is at right angles to or slightly inclined (up to 15°, preferably up to 5°) relative to the axis of rotation 2. The inner casing 11 is surrounded by an outer casing 12, which forms a boundary for the exhaust steam region 4 and is used for the flow deflection and guidance of the steam 5 emerging from the outlet opening 8. Outside the outer casing 12, the turbine shaft 7 is supported on appropriate bearings 17 (not explained in any more detail). A condenser 13 for condensing the steam 5 is disposed geodetically below the outer casing 12. The condenser 13 has a condenser casing 21, in which are disposed a large number of cooling tubes 18 (diagrammatically represented) through which cooling fluid, in particular cooling water, flows during operation of the condenser 13. Disposed below the cooling tubes 18, there is a condensate drain 22 into which the condensate, which is formed on the outside of the cooling tubes 18 during operation of the condenser, drips. In each lower space region of the condenser 13, an air cooler 19 is provided which is open toward the bottom and is formed at the top by walls inclined to one another in the manner of a roof. Each air cooler 19 is respectively connected to a vacuum pump (not shown in any more detail) by a suction conduit 20 emerging from its ridge.

During operation of the steam turbine 1, the steam 5 flows through the flow duct 6. After emerging from the outlet opening 8 into the exhaust steam region 4, a partial flow of the steam 5 is guided upward and a further partial flow is guided downward. The partial flow guided upward is deflected downward above the outlet opening 8 and flows, in an outlet flow region 4A (not specified in any more detail) downstream of the two flow guidance elements 10 into the condenser 13. This makes the total flow of steam more uniform and at least partial mixing takes place with the partial flow guided downward. The partial flow of the steam 5 flowing upward is respectively divided into two steam flows, in particular at an apex of the inner casing 11. These divided steam flows eddy and each forms a trailing vortex which extends from the apex of the inner casing 11 into the region of the respective flow guidance element 10. A spatial separation of these trailing vortices from the steam 5 flowing downward directly from the outlet opening 8 is achieved by each flow guidance element 10. By this, the formation of a shear flow between the trailing vortices and the steam 5 flowing directly downward is prevented in the region of the flow guidance elements 10, so that a reduction in the pressure loss when flowing into the condenser 13 is achieved.

Figure 2:
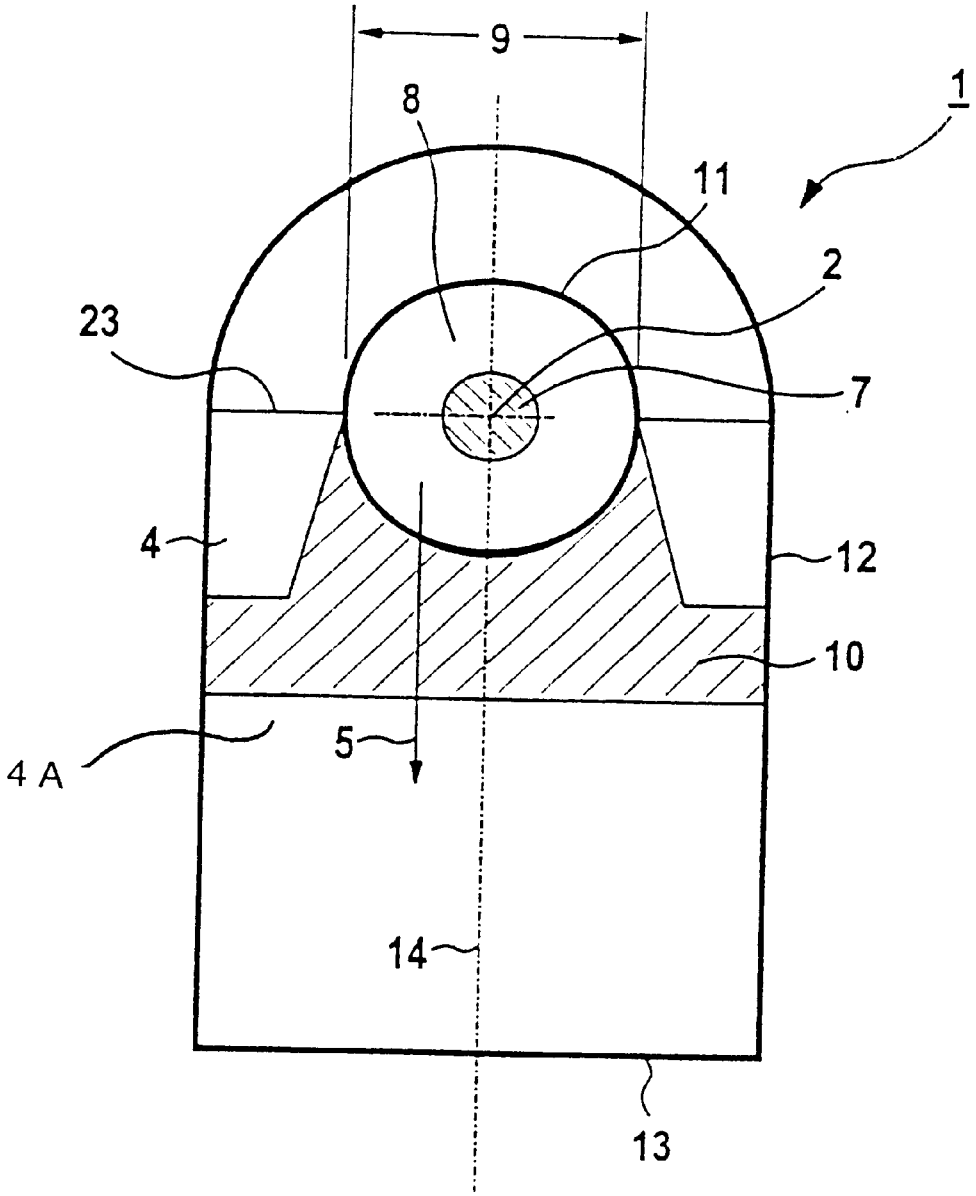
FIG. 2 is a cross-sectional view through an exhaust steam region of the low-pressure steam turbine.

FIG. 2 shows a cross section through the exhaust steam region 4 of the steam turbine 1, in particular of the low-pressure steam turbine 1 shown in FIG. 1. The outlet opening 8 has an annular cross section with an outlet diameter 9. The steam turbine 1 is embodied so that it can be split relative to a horizontal plane 23, in which the axis of rotation 2 is located. The flow guidance element 10 is disposed geodetically below the horizontal plane 23 and widens in the outlet flow direction 14 with an increasing distance from the horizontal plane 23. It is likewise possible for the flow guidance element 10 to have a constant width, mainly or at least in some regions, in the outlet flow direction 14. In addition, it can also be adjacent to the outlet opening 8 at a distance from the horizontal plane 23. The flow guidance element 10 encloses, in semi-circular shape, the outlet opening 8 as far as the horizontal plane 23 and is widened toward the outer casing 12. It is permanently connected, for example screwed or welded, to the outer casing 12. This achieves both a stiffening of the outer casing 12 in the exhaust steam region 4 and a permanent fastening of the flow guidance element 10.

Figure 3:
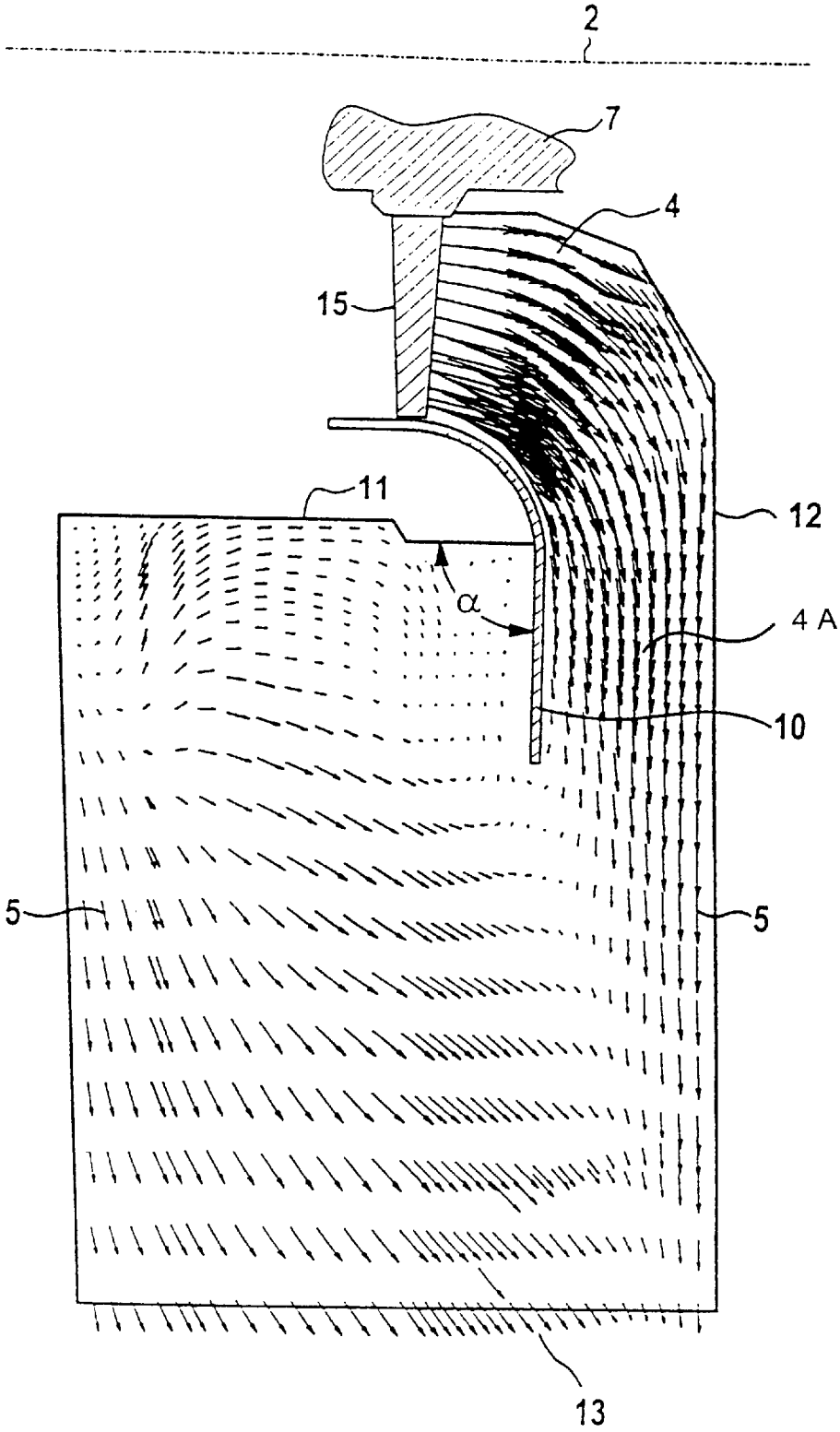
FIG. 3 is an excerpt through a longitudinal section of the exhaust steam region of the low-pressure steam turbine.

FIG. 3 shows an excerpt from the exhaust steam region 4 in the direction toward the condenser 13 and geodetically below the axis of rotation 2. In the flow region represented, the flow of the steam 5 is represented by arrows, a length of the arrows providing a measure of the flow velocity of the steam 5. It may be seen that the steam 5 emerging behind the last rotor blade 15 is deflected downward in the exhaust steam region 4 by approximately 90° and is simultaneously retarded in the process. Both an extension of the inner casing 11 and a corresponding configuration of the outer casing 12 are provided for deflecting the steam 5. The flow guidance element 10 abuts the extension of the inner casing 11, by which a duct region for the steam 5 deflected in this way is formed between the flow guidance element 10 and the outer casing 12. The flow guidance element 10 is inclined relative to the axis of rotation 2 by a guidance angle $\alpha$, which is preferably in the range between 70° and 110°, approximately 90° in the case shown. Geodetically below the flow guidance element 10, the flow of the steam 5 deflected downward meets the flow of the steam 5 deflected first upward and then downward. The interaction between these two partial flows is markedly reduced due to the configuration of the guidance segment 10 relative to the case where no flow guidance element 10 is provided. Likewise, the formation of a shear flow is at least markedly reduced by this and, therefore, a reduction in pressure losses is achieved. Due to the addition of the flow guidance element 10 around the outlet opening 8, which flow guidance element 10 extends both downward in the direction toward the condenser 13 and radially outward to the outer casing 12, an increase in the efficiency of the steam turbine is achieved by avoiding, or at least by reducing, pressure losses in the region of the flow guidance element 10. A more uniform flow in the outlet flow region 4A is also achieved.

I claim:

1. A steam turbine, comprising:

an axis of rotation;

an inlet for receiving steam and disposed above said axis of rotation;

an exhaust steam region for conducting the steam;

an outlet flow region;

a flow duct for conducting the steam and extending in a direction of said axis of rotation, said flow duct having an outlet opening formed therein with an outlet diameter, said flow duct widening toward said exhaust steam region to said outlet opening; and a substantially planar flow guidance element associated with said outlet opening for conducting the steam flowing out of said outlet opening, said flow guidance element extending beyond said outlet diameter of said outlet opening and extending along an outlet flow direction into said outlet flow region, said flow guidance element being one of widening along the outlet flow direction and having a substantially constant width, so that the steam is guided on both sides of said flow guidance element and a thorough mixing of the steam takes place downstream of said flow guidance element.

2. The steam turbine according to claim 1, wherein said flow guidance element is disposed geodetically below said axis of rotation.

3. The steam turbine according to claim 1, wherein said flow guidance element is inclined relative to said axis of rotation by a guidance angle of between 70° and 110°.

4. The steam turbine according to claim 3, wherein said flow guidance element is inclined relative to said axis of rotation by a guidance angle of between 85° and 95°.

5. The steam turbine according to claim 4, wherein said flow guidance element is inclined relative to said axis of rotation by a guidance angle of approximately 90°.

6. The steam turbine according to claim 1, wherein said flow guidance element is directly adjacent to said outlet opening.

7. The steam turbine according to claim 1, wherein said flow guidance element is a plate.

8. The steam turbine according to claim 1, including:

an inner casing surrounding said flow duct; and an outer casing surrounding said inner casing, and said flow guidance element being adjacent said outer casing.

9. The steam turbine according to claim 8, wherein said flow guidance element is fastened to said outer casing.

10. The steam turbine according to claim 1, wherein the steam turbine is a low-pressure steam turbine.

11. The steam turbine according to claim 1, wherein the steam turbine is a double-flow steam turbine.

12. The steam turbine according to claim 1, including a condenser and said flow guidance element is used for flow guiding the steam into said condenser.

13. A steam turbine, comprising:

a housing having an exhaust steam region for conducting steam and an outlet flow region;

a turbine shaft having an axis of rotation disposed in said housing;

an inlet for receiving the steam;

an inner casing surrounding said turbine shaft and defining a flow duct there-between, said flow duct fluidically communicating with said inlet and receiving the steam from said inlet, said flow duct fluidically communicating with and conducting the steam into said exhaust steam region, said flow duct extending in a direction of said axis of rotation and having an outlet opening with an outlet diameter, said flow duct widening towards said exhaust steam region to said outlet opening; and a substantially planar flow guidance element associated with said outlet opening for conducting the steam flowing out of said outlet opening, said flow guidance element extending beyond said outlet diameter of said outlet opening and extending along an outlet flow direction into said outlet flow region, said flow guidance element being one of widening along the outlet flow direction and having an substantially constant width, so that the steam can be guided on both sides of said flow guidance element and a thorough mixing of the steam takes place downstream of said flow guidance element.

* * * * *